US006213460B1

(12) United States Patent
Cahill et al.

(10) Patent No.: US 6,213,460 B1
(45) Date of Patent: Apr. 10, 2001

(54) LABEL SUPPORT

(75) Inventors: Daniel Paul Cahill, Verona; Louann Behymer Samuels, Georgetown, both of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/438,720

(22) Filed: Nov. 11, 1999

(51) Int. Cl.[7] ..... B65H 1/00
(52) U.S. Cl. ..... 271/161; 271/145; 271/167
(58) Field of Search ..... 271/145, 148, 271/161, 167, 147

(56) References Cited

U.S. PATENT DOCUMENTS

| | | | | |
|---|---|---|---|---|
| 2,540,090 | * | 2/1951 | Brackney | 271/148 |
| 3,871,641 | | 3/1975 | Marx et al. . | |
| 5,895,040 | | 4/1999 | Oleska et al. . | |
| 5,918,874 | | 7/1999 | Armstrong et al. . | |

FOREIGN PATENT DOCUMENTS

| | | | | |
|---|---|---|---|---|
| 0185773 | * | 8/1988 | (JP) | 271/161 |
| 406100179 | * | 4/1994 | (JP) | 271/161 |
| 406156749 | * | 6/1994 | (JP) | 271/147 |

* cited by examiner

*Primary Examiner*—H. Grant Skaggs
(74) *Attorney, Agent, or Firm*—John A. Brady

(57) ABSTRACT

A label support for an integrated label, which includes a label portion and a thinner paper portion, includes a base having a support surface with its rear end higher than its front. When the label support is supported by a support surface of a media support tray, its front end is closest to an inclined dam of the media support tray. The label support has at least its rear end spaced from the support surface of the media support tray. In one embodiment, the base of the label support has a first substantially horizontal portion connected by an inclined portion to a second substantially horizontal portion, which rests on the support surface of the media support tray. This embodiment extends for less than the length of the support surface of the media support tray for sliding along the support surface of the media support tray to accommodate varying lengths of the integrated label. In another embodiment, the base has a portion of its support surface closest to its front inclined toward its front with its entire support surface spaced from the support surface of the media support tray. In each of the embodiments, the trailing edges of the integrated labels engage two rear restraints, which extend from the rear of the base and are at an acute angle less than the complement of the obtuse angle of the dam of the media support tray, to enable the uppermost of the integrated labels, which are stacked on the support surface of the base, to be advanced into engagement with the dam for feeding to a processing station of a printer or copier.

20 Claims, 3 Drawing Sheets

LABEL SUPPORT

FIELD OF THE INVENTION

This invention relates to a label support and, more particularly, to a label support for an integrated label having at least one portion thicker than at least one other portion with the label support used in a media support tray.

BACKGROUND OF THE INVENTION

In printers and copiers, for example, sheets of media are fed from a media support tray having a plurality of sheets of media stacked therein for sequential feeding to the printer or copier. Two examples of feeding sheets of media from a support tray are disclosed in U.S. Pat. No. 5,895,040 to Oleska et al and U.S. Pat. No. 5,918,874 to Armstrong et al, which are incorporated by reference herein.

Integrated labels include a paper backing having a label portion releasably adhered thereto whereby the label portion may be removed after printing on the label portion for application to an article, for example. For example, pharmacies now utilize an integrated label in which a label portion has spaces for printing the patient's name, the physician's name, the name of the drug, and the dosage from a computer controlled printer.

The remainder of the paper backing constitutes a paper portion, which is not covered by the label portion and is larger than the label portion. One side of the paper portion could have instructions and the side effects for the particular drug printed thereon by the printer during the passage of the integrated label through a processing station of the printer. The other side of the paper portion could have printed matter already on it since it is on the opposite side from where printing occurs.

With this type of integrated label, the label portion is several times thicker than the paper backing to which it is adhered. Thus, the paper backing functions as a substrate for the label portion.

As shown and described in each of the aforesaid Oleska et al and Armstrong et al patents, the media support tray has a dam inclined upwardly from the support surface on which the sheets of media are stacked. Each sheet of media has its leading edge advanced into the dam by a pair of feed rollers and then advanced upwardly along the dam and a predetermined path thereafter to a processing station in the printer or copier. With narrow width sheets, only one of the pair of rollers is employed in the aforesaid Armstrong et al patent.

When the thickness of the label portion is several times thicker than the paper backing to which it is adhered, the leading edge of each of the label portions may not advance up the dam of the media support tray. This is particularly true when the label portion of the integrated label extends rearwardly from the leading edge of each of the integrated labels.

When the integrated labels of varying thicknesses are in a stack on the support surface of the media support tray, the uppermost labels in the stack tend to slide away from the dam so as to be spaced further away from the dam when stacked on the support surface of the media support tray. With the leading edge of the integrated label spaced from the dam, the leading edge of the integrated label may curl down as the integrated label is advanced by feed rollers. When this occurs, the label portions will occasionally turn down instead of moving up the dam. As a result, no integrated label can be fed from the stack.

Another problem in feeding integrated labels from a media support tray can occur if a user adds sheets of the integrated labels to a partially filled tray of the sheets of the integrated labels so that they overhang the initial integrated labels; this occurs when the user places the leading edge of the label portion of each of the new integrated labels in contact with the dam, for example. Accordingly, because of the weight of the label portion of each of the new integrated labels being unsupported, each of the uppermost integrated labels will tend to curl downwardly at its leading edge. This also can prevent feeding of the integrated labels.

Instead of loading the integrated labels so that the label portion of each of the new integrated labels extends beyond the initial integrated labels in the stack, the label portions of the new integrated labels could be loaded by a user so that they are further away from the dam than the initial integrated labels on which they were stacked. When this occurs, the location of the uppermost sheet of the stacked integrated labels may be such that the location of the feed rollers is too far forward for the feed rollers to engage the uppermost sheet to advance any sheet of the stacked integrated labels into engagement with the dam.

A further problem can occur when the uppermost sheet of the stack of the initial sheets of integrated labels extends into engagement with the dam prior to additional sheets of the integrated labels being stacked thereon. When this occurs, there can be multiple feeding of the lowermost sheet of the added sheets of the integrated labels along with the uppermost sheet of the integrated label of the initial stack and possibly one or more sheets of the integrated labels therebeneath.

Thus, several problems can occur when an integrated label has its label portion substantially thicker than the remainder of the integrated label, particularly when the label portion of the integrated label extends rearwardly from its leading edge. These problems include jamming because of the curling downwardly of the particular label portion, inability to feed any sheets of the integrated labels, and multiple sheet feeding, for example.

SUMMARY OF THE INVENTION

The present invention satisfactorily solves the foregoing problems through providing a label support for use with a media support tray having a media support surface. The label support has inclined rear restraints, which bear against the trailing edge of each of the stacked integrated labels, at a smaller acute angle than the complement of the obtuse angle of the inclined dam of the media support tray to the support surface of the media support tray. This results in the stack of the integrated labels having their leading edges forming a stack end substantially parallel to the dam.

Additionally, one embodiment of the invention has only the rear portion of its support surface spaced from the support surface of the media support tray and substantially parallel thereto. The support surface has a front portion, which is connected to the rear portion by an inclined portion, resting on the support surface of the media support tray.

This arrangement contemplates the sheets of the integrated labels being disposed so that strippers of a sheet feeding mechanism of each of the aforesaid Oleska et al and Armstrong et al patents, for example, can remove sheets when the height of the stack is too high. The height of the stack must be limited because feeding of the sheets will not occur if the stack is too high.

In another embodiment of the invention, the entire support surface of the label support is spaced above the entire support surface of the media support tray. The support surface of the label support is inclined toward its front end for a portion, approximately one-fourth, of its length. This embodiment is particularly effective when the label portion of each of the integrated labels extends rearwardly from the leading edge of the integrated label.

An object of this invention is to provide a label support for integrated labels for use in a media support tray of a printer or copier.

Another object of this invention is to provide a label support for integrated labels having varying thicknesses in their feed direction.

Other objects of this invention will be readily perceived from the following description, claims, and drawings.

BRIEF DESCRIPTION OF THE DRAWINGS

The attached drawings illustrate preferred embodiments of the invention, in which.

DETAILED DESCRIPTION OF PREFERRED EMBODIMENTS

Figure 1:
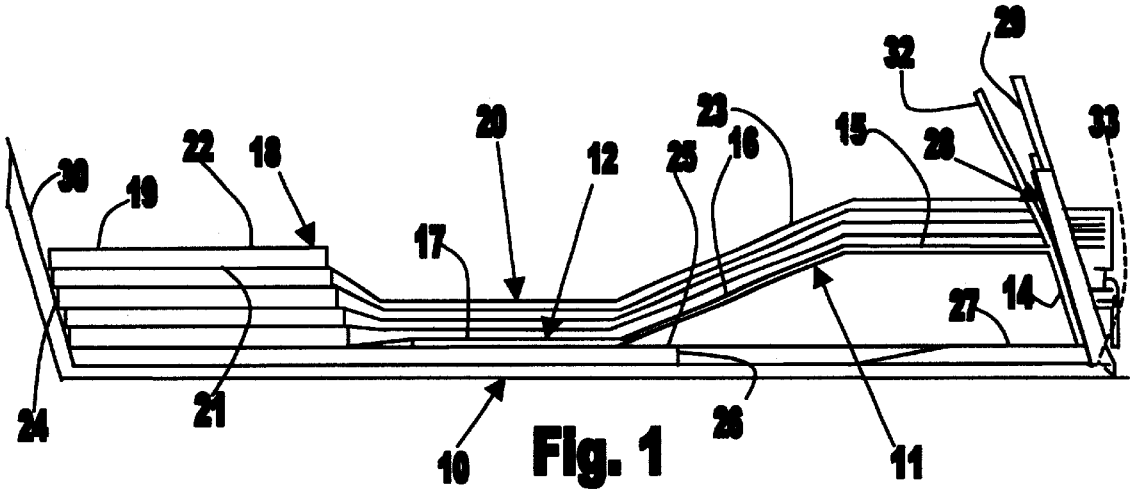
FIG. 1 is a schematic side view of a portion of a media support tray in which one embodiment of the label support of the present invention is disposed with the label and paper portions of the integrated labels substantially enlarged to show their relative sizes.

Referring to the drawings and particularly FIG. 1, there is shown a media support tray 10 having a label support 11 of the present invention supported thereby. The label support 11 includes a base 12 having a first spacing or support element 14 extending downwardly from its rear.

The base 12 includes a first or upper substantially horizontal portion 15, an inclined portion 16, and a second or lower substantially horizontal portion 17. The inclined portion 16 connects the forward end of the first or upper substantially horizontal portion 15 with the rear end of the second or lower substantially horizontal portion 17. The portions 15–17 constitute a support surface for a stack 18 of sheets 19 of integrated labels 20.

Each of the sheets 19 of the integrated labels 20 has a paper backing 21 supporting a label portion 22. The remainder of the paper backing 21 constitutes a paper portion 23. The thickness of the label portion 22 is at least several times greater than the thickness of the paper portion 23. In one form, the integrated label 20 has the label portion 22 extending rearwardly from its leading edge 24 for a distance substantially less than the length of the paper portion 23.

The spacing element 14, which preferably extends the width of the base 12, maintains the first or upper substantially horizontal portion 15 of the base 12 in spaced relation to a support surface 25 of the media support tray 10 and substantially parallel thereto. The support surface 25 of the media support tray 10 has a recess 26 to receive a support surface 27 of a rear restraint body 28, which is slidable in the recess 26. The rear restraint body 28 is held in a desired position in the recess 26 by a detent (not shown) thereon cooperating with one of a plurality of parallel grooves in the bottom of the recess 26. The support surface 25 of the media support tray 10 is deemed to include the support surface 27 of the rear restraint body 28 as they are in the same horizontal plane.

Figure 2:
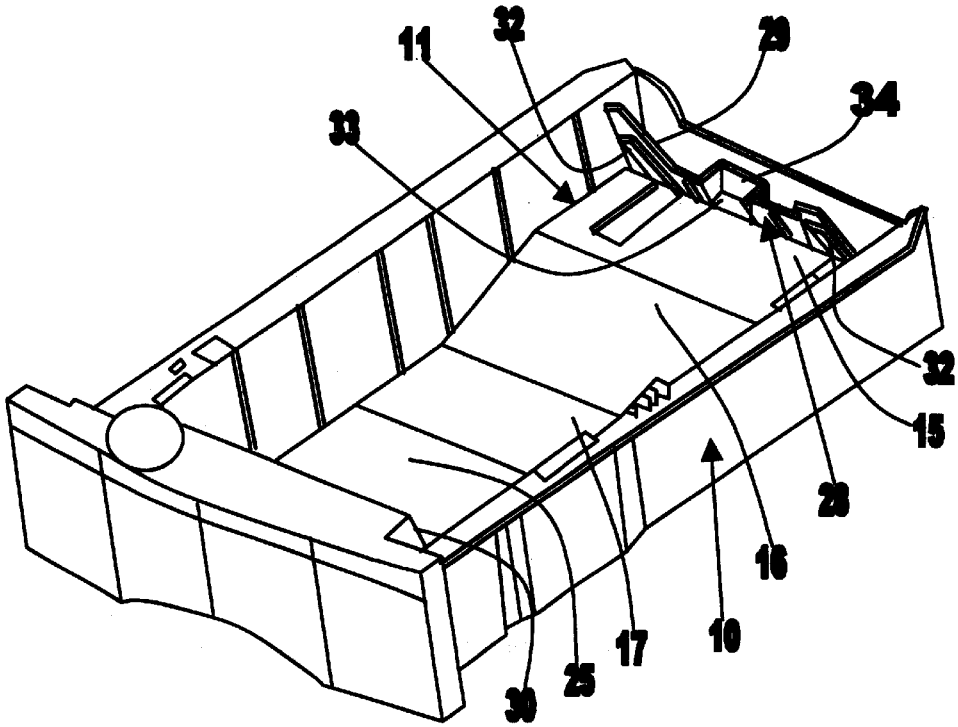
FIG. 2 is a perspective view of a media support tray having the label support of FIG. 1 disposed therein without any sheets of the integrated labels disposed therein.

The spacing element 14 is disposed at an obtuse angle to the first or upper substantially horizontal portion 15 and substantially parallel to an inclined rear restraint 29 of the rear restraint body 28. The inclined rear restraint 29 is substantially parallel to an inclined dam 30 (see FIG. 2) of the media support tray 10.

The inclined rear restraint 29, which extends about two-thirds of the width of the base 12, is slidable along the bottom of the recess 26 in the support surface 25 of the media support tray 10. The overall length of the label support 11 allows the inclined rear restraint body 28 to move longitudinally along the length of the recess 26 in the support surface 25 of the media support tray 10 to accommodate various lengths of the integrated labels 20.

The label support 11 has two inclined rear restraints 32 (see FIG. 1),which are at an acute angle to the first or upper substantially horizontal portion 15 of the base 12 and at a smaller angle than the acute angle of the inclined rear restraint 29 to the support surface 27 of the of the rear restraint body 28. Therefore, as shown in FIG. 1, the inclined rear restraints 32 of the base 12 cause the leading edges 24 of the stacked sheets 19 of the integrated labels 20 to form a stacked end substantially parallel to the dam 30. This insures that the uppermost sheet 19 of the integrated labels 20 can more easily engage the dam 30 than any of the other sheets 19 of the integrated labels 20.

The second or lower substantially horizontal portion 17 of the base 12 rests on the support surface 25 of the of the media support tray 10. However, the thickness of the base 12, which is preferably formed of polycarbonate sold under the trademark LEXAN 500, of the label support 11 is only 2 mm. As a result, the second or lower substantially horizontal portion 17 of the base 12 is in substantially the same horizontal plane as the support surface 25 of the media support tray 10.

To prevent transverse movement of the label support 11, a projection 33 (see FIG. 2) extends rearwardly from the first support element 14 (see FIG. 1). The projection 33 (see FIG. 2) extends into a slot 34 in the inclined rear restraint 29 of the inclined rear restraint body 28.

Figure 3:
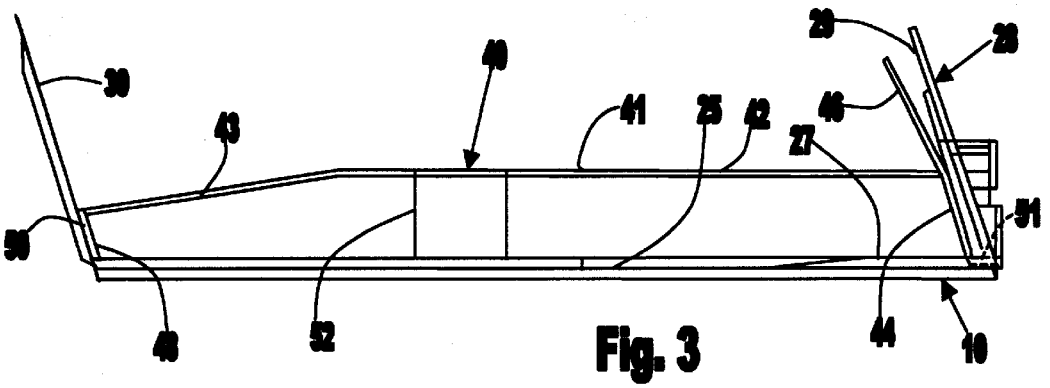
FIG. 3 is a schematic side view of another embodiment of the label support of the present invention disposed in a media support tray without any sheets of the integrated labels supported thereby.

Referring to FIG. 3, there is shown a label support 40. The label support 40 includes a base 41, which is spaced from the support surface 25 of the media support tray 10 and the support surface 27 of the inclined rear restraint body 28. The entire upper surface of the base 41 constitutes a support surface for the stack 18 (see FIG. 1) of the sheets 19 of the integrated labels 20.

The base 41 has a first portion 42 substantially parallel to the support surface 25 of the media support tray 10 and a second portion 43 inclined from the portion 42 to its front end. This provides more room for the label portion 22 (see FIG. 1) of the integrated labels 20.

Figure 4:
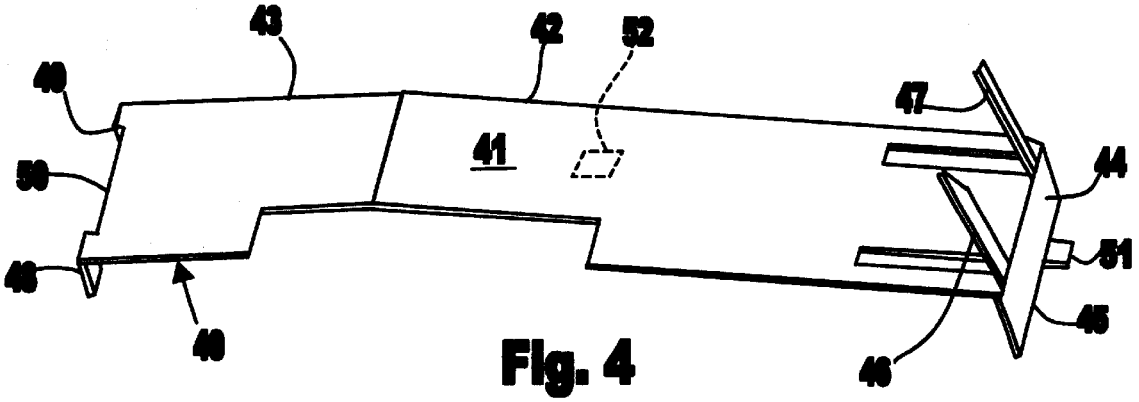
FIG. 4 is a perspective view of the label support of FIG. 3 without the media support tray.

The rear end of the base 41 (see FIG. 4) has a first support or spacing element 44 extending downwardly and rearwardly therefrom. The first support element 44, which preferably extends the width of the base 41, has its bottom edge 45 resting on the support surface 25 (see FIG. 3) of the media support tray 10.

Two inclined rear restraints 46 (see FIG. 4) and 47 extend upwardly from the rear end of the base 41 adjacent opposite sides of the base 41. The inclined rear restraints 46 and 47 are at an acute angle to the base 41.

The inclined rear restraints 46 and 47 are at a smaller acute angle to the base 41 than the angle of the inclined rear restraint 29 (see FIG. 3) of the rear restraint body 28 in the same manner as the rear restraints 32 (see FIG. 1) of the label support 11. This insures that the uppermost sheet 19 of the integrated labels 20 can more easily engage the dam 30 than any of the other sheets 19 of the integrated labels 20.

The base 41 (see FIG. 4) has two second support or spacing elements 48 and 49 extending downwardly from its forward end 50. The two support elements 48 and 49 are preferably substantially perpendicular to the base 41.

The two support elements 48 and 49 space the forward end 50 of the base 41 from the support surface 25 (see FIG. 3) of the media support tray 10 a lesser distance than the rear end of the base 41 due to the first support element 44 having a greater length than each of the two second support elements 48 and 49. This disposition of the forward end 50 of the base 41 closer to the support surface 25 of the media support tray 10 provides more stacking space for the label portion 22 (see FIG. 1) of the integrated label 20 than for the paper portion 23.

To prevent transverse movement of the label support 40, a projection 51 extends rearwardly from the bottom edge 45 of the first support element 44. The projection 51 extends into the slot 34 (see FIG. 2) in the inclined rear restraint 29 of the rear restraint body 28.

The base 41 has an intermediate support 52 (see FIG.3 ) extending downwardly from the bottom of the base 41 for engaging the support surface 25 of the media support tray 10. This supports the label support 40 intermediate its ends.

The label support 40 (see FIG. 3) does not allow adjustment of the inclined rear restraint 29 of the rear restraint body 28 since the label support 40 extends for the length of the support surface 25 of the media support tray 10. Accordingly, only one length of the integrated labels 20 can be used in this embodiment.

Figure 5:
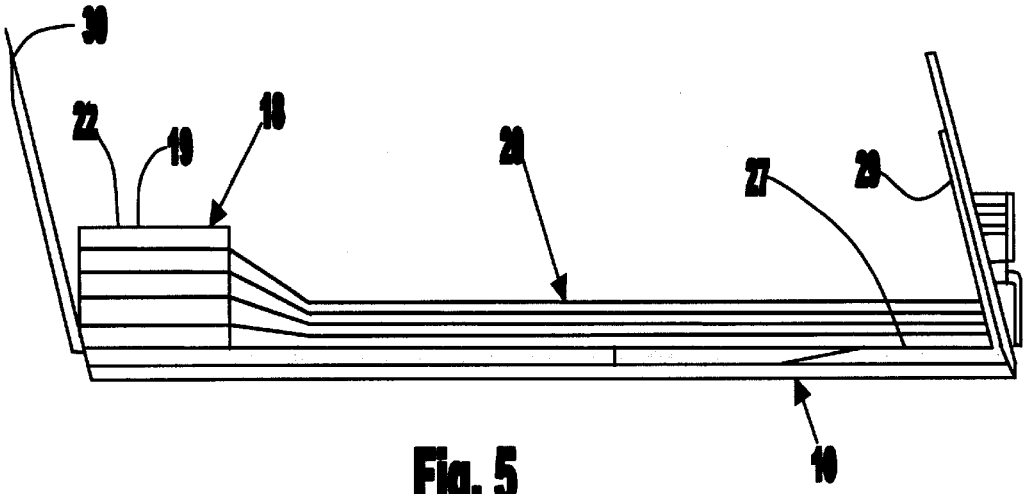
FIG. 5 is a schematic side view of a media support tray without a label support of the present invention and having a stack of integrated labels on its support surface with the uppermost sheets of the integrated labels spaced further from the dam of the media support tray than the lowermost sheets and with the label and paper portions of the integrated labels substantially enlarged to show their relative sizes.

In FIG. 5, the media support tray 10 does not have the label support 11 (see FIG. 1) or the label support 40 (see FIG. 3). As a result, the uppermost sheets 19 (see FIG. 5) of the integrated labels 20 of the stack 18 are spaced from the dam 30. This can cause the label portion 22 of the integrated label 20 to curl downwardly and cease to enable advancement of any of the sheets 19 of the integrated labels 20.

Figure 6:
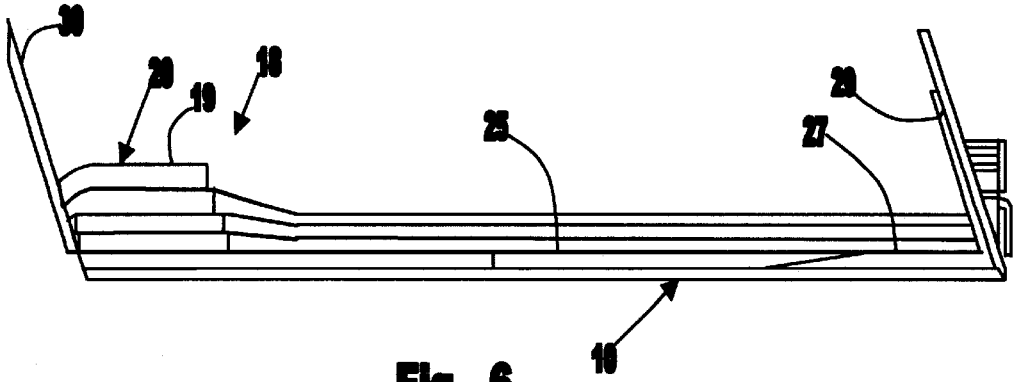
FIG. 6 is a schematic side view of a media support tray, similar to FIG. 5, but having the uppermost sheets of the integrated labels extending beyond the remainder of the stack with the label and paper portions of the integrated labels substantially enlarged to show their relative sizes.

In FIG. 6, the media support tray 10 does not have the label support 11 (see FIG. 1) or the label support 40 (see FIG. 3). This discloses another problem when the sheets 19 (see FIG. 6) of the integrated labels 20 are supported in the stack 18 on the support surface 25 of the media support tray 10. One or more of the uppermost sheets of the sheets 19 of the integrated labels 20 of the stack 18 has been loaded so as to extend beyond the remainder of the sheets 19 of the integrated labels 20 of the stack 18. The weight of the label portion 22 of at least the uppermost sheet 19 causes it to curl downwardly because it is not supported by the stack 18. The uppermost sheet 18 also could curl downwardly due to its properties.

Figure 7:
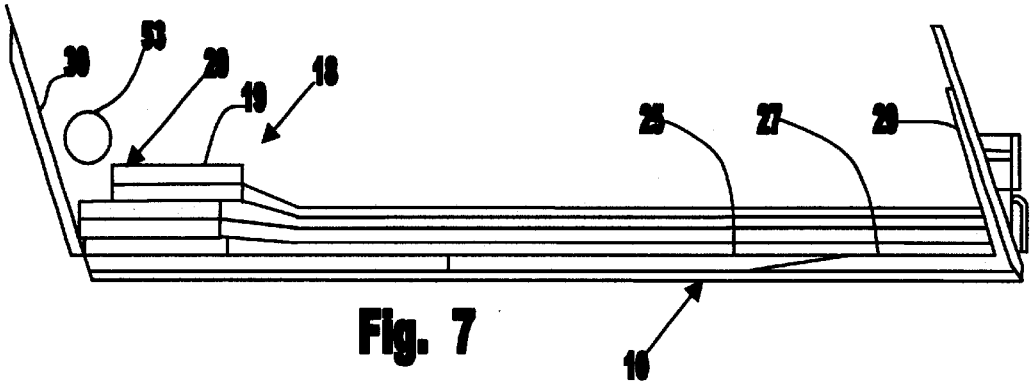
FIG. 7 is a schematic side view of a media support tray without a label support of the present invention and having a stack of integrated labels on its support surface in which the uppermost sheets of the integrated labels have their leading edges rearward of the leading edges of the lowermost sheets of the integrated labels in the stack and with the label and paper portions of the integrated labels substantially enlarged to show their relative sizes.

In FIG. 7, the media support tray 10 does not have the label support 11 (see FIG. 1) or the label support 40 (see FIG. 3) therein. At least the uppermost sheets 19 (see FIG. 7) of the integrated labels 20 of the stack 18 have their leading edges spaced further from the dam 30 of the media support tray 10 than the lowermost sheets. With a pair of feed rollers 53 disposed as shown in FIG. 7, the feed rollers 53 could never engage the uppermost sheets 19 of the integrated labels 20 of the stack 18. Thus, none of the sheets 19 of the integrated labels 20 of the stack 18 could be advanced. Versions of the feed rollers 53 are particularly shown and described in U.S. Pat. No. 5,527,026 to Padgett et al, which is incorporated by reference herein.

Figure 8:
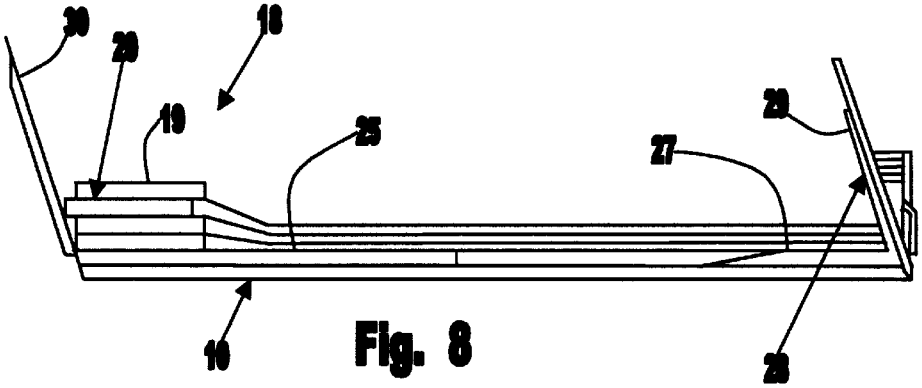
FIG. 8 is a schematic side view of a media support tray without a label support of the present invention and having a stack of sheets of the integrated labels in which an intermediate sheet in the stack is advanced against the dam while the sheets thereabove are spaced from the dam due to having been stacked later and with the label and paper portions of the integrated labels substantially enlarged to show their relative sizes.

In FIG. 8, the media support tray 10 does not have the label support 11 (see FIG. 1) or the label support 40 (see FIG. 3) therein. One of the intermediate sheets 19 (see FIG. 8) of the integrated labels 20, disposed in the middle of the stack 18, is advanced into engagement with the dam 30. Accordingly, after the uppermost sheets 19 of the integrated labels 20 of the stack 18 have been fed, there will be a multiple feeding when there is feeding of the sheet 19 above the sheet 19 engaging the dam 30.

While the label support 40 (see FIG. 3) has been shown and described as being supported at its front and rear ends, it should be understood that this is not a requisite for satisfactory operation. Thus, the label support 40 could be supported by support or spacing elements extending from its sides rather than its front and rear ends, if desired. Of course, this would require a different support arrangement for the projection 51. A similar support arrangement could be utilized with the first substantially horizontal portion 15 (see FIG. 1) of the label support 11.

While the integrated labels 20 have been shown and described as having the label portion 22 extending rearwardly from the leading edge 24 of the integrated label 20, it should be understood that the label portion 22 could be disposed other than extending rearwardly from the leading edge 24 of the integrated label 20. Thus, the label portion 22 could be positioned on the paper backing 21 (see FIG. 1) intermediate the ends of the integrated label 20 or even extend forwardly from the trailing edge of the integrated label 20, if desired. Each of these could still be satisfactorily fed with either of the embodiments.

An advantage of this invention is that it substantially eliminates double feeding or jamming problems when feeding integrated labels in which each of the integrated labels has varying thicknesses in its feeding direction. Another advantage of this invention is that it prevents paper jams when feeding integrated labels from a media support tray of a printer or copier.

For purposes of exemplification, preferred embodiments of the invention have been shown and described according to the best present understanding thereof. However, it will be apparent that changes and modifications in the arrangement and construction of the parts thereof may be resorted to without departing from the spirit and scope of the invention.

What is claimed is:

1. A label support for an integrated label having a continuous paper backing and a label portion releasably adhered to a portion of the continuous paper backing to form a label portion thicker than a paper portion formed by the remainder of the continuous paper backing so that the integrated label has varying thicknesses in its feeding direction for use in a media support tray having a support surface and a dam inclined at an angle to the support surface, said label support including:

a base having a support surface on which integrated labels of varying thicknesses in their feeding direction can be stacked;

said base having at least one restraint extending upwardly from its rear at an acute angle to said support surface of said base to engage each of the integrated labels at its trailing edge when the integrated labels are supported by said support surface of said base, said restraint having an acute angle smaller than the complement of the obtuse angle of the dam in the media support tray against which each of the integrated labels has its leading edge advanced during feeding;

and said base having at least one first spacing element extending downwardly to engage the support surface of the media support tray in which said label support is disposed to space at least the rear of said base from the support surface of the media support tray to dispose said support surface of said base higher at its rear end than at its front end.

2. The label support according to claim 1 in which said base has at least one second spacing element extending downwardly therefrom adjacent its front end to dispose at least a portion of said support surface of said base closest to its front end at a downward inclination toward its front end and in spaced relation to the support surface of the media support tray throughout its length.

3. The label support according to claim 2 in which said at least one first spacing element extends downwardly for substantially the width of said base.

4. The label support according to claim 3 including preventing means for preventing transverse movement of said label support relative to the media support tray in which said label support is disposed.

5. The label support according to claim 4 in which said preventing means includes an element supported by said at least one first spacing element and cooperating with the media support tray in which said label support is disposed to prevent transverse movement of said label support.

6. The label support according to claim 5 in which said element includes a projection extending rearwardly from said at least one first spacing element.

7. The label support according to claim 6 including at least one support element extending downwardly from said base intermediate its front and rear ends to engage the support surface of the media support tray in which said label support is disposed to provide intermediate support to said label support.

8. The label support according to claim 5 including at least one support element extending downwardly from said base intermediate its front and rear ends to engage the support surface of the media support tray in which said label support is disposed to provide intermediate support to said label support.

9. The label support according to claim 4 including at least one support element extending downwardly from said base intermediate its front and rear ends to engage the support surface of the media support tray in which said label support is disposed to provide intermediate support to said label support.

10. The label support according to claim 3 including at least one support element extending downwardly from said base intermediate its front and rear ends to engage the support surface of the media support tray in which said label support is disposed to provide intermediate support to said label support.

11. The label support according to claim 2 including preventing means for preventing transverse movement of said label support relative to the media support tray in which said label support is disposed.

12. The label support according to claim 11 in which said preventing means includes an element supported by said at least one first spacing element and cooperating with the media support tray in which said label support is disposed to prevent transverse movement of said label support.

13. The label support according to claim 12 in which said element includes a projection extending rearwardly from said at least one first spacing element.

14. The label support according to claim 12 including at least one intermediate support element extending downwardly from said base intermediate its front and rear ends to engage the support surface of the media support tray in which said label support is disposed to provide intermediate support to said label support.

15. The label support according to claim 13 including at least one intermediate support element extending downwardly from said base intermediate its front and rear ends to engage the support surface of the media support tray in which said label support is disposed to provide intermediate support to said label support.

16. The label support according to claim 11 including at least one intermediate support element extending downwardly from said base intermediate its front and rear ends to engage the support surface of the media support tray in which said label support is disposed to provide intermediate support to said label support.

17. The label support according to claim 2 including at least one intermediate support element extending downwardly from said base intermediate its front and rear ends to engage the support surface of the media support tray in which said label support is disposed to provide intermediate support to said label support.

18. The label support according to claim 1 in which said base includes:

a first substantially horizontal portion spaced from the support surface of the media tray support;

a second substantially horizontal portion forwardly of said first substantially horizontal portion;

an inclined portion connecting said first substantially horizontal portion and said second substantially horizontal portion;

each of said first substantially horizontal portion, said second substantially horizontal portion, and said inclined portion forming said support surface of said base;

said first substantially horizontal portion being spaced from the support surface of the media support tray;

and said second substantially horizontal portion resting on the support surface of the media support tray when said label support is supported by the media support tray.

19. The label support according to claim 18 including said at least one first support element extending downwardly from said first substantially horizontal portion adjacent its rear to space said first substantially horizontal portion from the support surface of the media support tray in which said label support is disposed.

20. A label support for an integrated label having a continuous paper backing and a label portion releasably adhered to a portion of the continuous paper backing to form a label portion thicker than a paper portion formed by the remainder of the continuous paper backing so that the integrated label has varying thicknesses in its feeding direction for use in a media support tray having a support surface and a dam inclined at an angle to the support surface, said label support including:

a base having a support surface on which integrated labels of varying thicknesses in their feeding direction can be stacked;

said base having at least one restraint extending upwardly from its rear at an acute angle to said support surface of said base to engage each of the integrated labels at its trailing edge when the integrated labels are supported by said support surface of said base, said restraint having an acute angle smaller than a complement of the obtuse angle of the dam in the media support tray against which each of the integrated labels has its leading edge advanced during feeding;

at least a portion of said support surface of said base closest to its front end being inclined toward its front;

and at least a portion of said base being spaced from the support surface of the media support tray.

* * * * *